United States Patent [19]

Bjorklund et al.

[11] Patent Number: 4,521,450

[45] Date of Patent: Jun. 4, 1985

[54] METHOD OF INCREASING THE ELECTRICAL CONDUCTIVITY OF CELLULOSE-BASED MATERIALS OR OTHER IMPREGNABLE MATERIALS

[75] Inventors: Robert Bjorklund, Linköping; Hans Gustavsson, Västerås; Ingemar Lundström, Linköping; Bertil Nygren, Västerås, all of Sweden

[73] Assignee: ASEA Aktiebolag, Västerås, Sweden

[21] Appl. No.: 505,856

[22] Filed: Jun. 20, 1983

[30] Foreign Application Priority Data

Jun. 22, 1982 [SE] Sweden ..... 8203863
Feb. 1, 1983 [SE] Sweden ..... 8300529

[51] Int. Cl.[3] ..... B05D 5/12

[52] U.S. Cl. ..... 427/121; 427/255.6; 427/302; 427/303; 427/389.9; 427/391; 252/518; 252/519; 528/490

[58] Field of Search ..... 427/121, 254, 255.1, 427/255.6, 302, 303, 324, 389.9, 391, 392, 394, 395, 439; 252/518, 519; 527/312; 528/490

[56] References Cited

U.S. PATENT DOCUMENTS 3,909,195 9/1975 Machell et al. ..... 8/115.7

OTHER PUBLICATIONS

G. P. Gardini, "Advances in Hetercyclic Chemistry," A. R. Katritzky and A. J. Boulton, eds., vol. 15, (1973), pp. 95–96.

Street et al., *Molecular Crystals and Liquid Crystals,* vol. 83, Nos. 1–4 (1982), "Preparation and Characterization of Neutral and Oxidized Polypyrrole Films", pp. 1285–1296.

*Primary Examiner*—Michael R. Lusignan
*Assistant Examiner*—K. Jaconetty
*Attorney, Agent, or Firm*—Watson, Cole, Grindle & Watson

[57] ABSTRACT

The electrical conductivity of solid, impregnable materials, such as cellulose-based insulating materials, can be increased by supplying to the solid impregnable material a substance with the ability, during polymerization of a pyrrole compound comprising at least one of the substances pyrrole and N-methylpyrrole, to give a polymer with higher electrical conductivity than the solid impregnable material, as well as a pyrrole compound of the kind stated, whereafter the pyrrole compound is transformed into a polymer in the solid, impregnable material.

10 Claims, No Drawings

METHOD OF INCREASING THE ELECTRICAL CONDUCTIVITY OF CELLULOSE-BASED MATERIALS OR OTHER IMPREGNABLE MATERIALS

In, for example, transformers with a high direct voltage level, the great difference in the electrical conductivity between the oil or other used insulating fluid and the solid insulating material, such as pressboard and paper, leads to considerable problems. The solid insulating material is charged to a very considerable extent, which must be taken into consideration when dimensioning the solid insulating material and involves considerable disadvantages.

The above-mentioned problems could be eliminated, or at least could be considerably reduced, by the use of solid insulating materials with a suitably adapted conductivity. The present invention makes possible the manufacture of such insulating materials. According to the invention, solid impregnable insulating materials with a predetermined conductivity can be manufactured. The conductivity can be controlled to a desired value by selecting materials and conditions for the treatment of the solid insulating material. The product obtained through the treatment has a good stability in terms of electrical and mechanical properties, and therefore the risk of harmful side effects in use of the product is small. The bond between the solid impregnable material and the conducting material is extremely good, and therefore the risk of fragments of the conducting material spreading to the surroundings, for example to surrounding transformer oil, is extremely small. Since the product manufactured has electronic conductivity, there will be no depletion of conducting materials therein, as is the case with products where the conducting material has ionic conductivity. The finished conducting product can be manufactured in a few minutes.

From the article "Preparation and Characterization of Neutral and Oxidized Polypyrrole Films" by G. B. Street, T. C. Clarke, M. Krounbi, K. Kanazawa, V. Lee, P. Pfluger, J. C. Scott and G. Weiser, IBM Research Laboratory, San Jose, Calif. (Proceedings of the International Conference on Low-Dimensional Conductors, Boulder, Colo., Aug. 9–14, 1981, Molecular Crystals and Liquid Crystals, 1982, 83(1–4), pp. 1285–86), it is known that polypyrrole films can be made conducting by the oxidation of the films as such with different metal-salt solutions containing $Ag^+$, $Cu^{2+}$ and $Fe^{3+}$. The polypyrrole films are manufactured electrochemically, which is a time-wasting process and takes several hours. The polymerization of pyrrole and pyrrole derivate in a solution in the presence of $FeCl_3$ and an acid or in the presence of $FeCl_2$ and hydrogen peroxide under the formation of "pyrrole black" in the form of a powder is also described in articles referred to in the above-mentioned publication without any statement about the electrical conductivity of the powder being given. The yield during the polymerization is also very low after a reaction time of several days.

More particularly, the present invention relates to a method of increasing the electrical conductivity of solid impregnable materials, such as cellulose-based insulating materials, which is characterized in that the solid impregnable material is supplied with a substance with the ability, during polymerization of a pyrrole compound comprising at least one of the substances pyrrole and N-methylpyrrole, to give a polymer with higher electrical conductivity than the impregnable material, as well as with a pyrrole compound of the kind stated, whereafter the pyrrole compound is transformed into a polymer in the solid impregnable material.

The impregnable material may, among other things, be a cellulose-based material such as pressboard, paper, cellulose fiber or a woven or felted product of cotton, a product consisting of matted-together polymer fibres, such as a so-called non-woven fabric, an inorganic porous material, such as porcelain, or a plastic material such as cast epoxy resin containing voids.

The substance with the ability during polymerization of the pyrrole compound to give a polymer with higher electrical conductivity than the solid impregnable material preferably consists of a chemical compound containing a metal ion, which is capable of changing valence. Examples of such compounds are ferric compounds such as $FeCl_3$ and $Fe_2(SO_4)_3$, further $Ce(SO_4)_2$, $K_3(Fe(CN)_6)$, $H_3PMo_{12}O_{40}$ and $CrO_3$. Among these compounds, ferric compounds are preferred. However, it is also possible to use other substances than those exemplified to bring about conducting pyrrole, among other things a mixture of an oxidant such as $H_2O_2$ and a chemical compound containing a metal ion which does not need to change valence, for example $AlCl_3$, or a chemical compound containing a metal ion capable of changing valence, for example $FeCl_2$, $CrCl_3$ or one of the compounds exemplified above having this property.

The conductivity of a material impregnated according to the invention can be controlled by that amount of the substance, having the ability to give a conducting polypyrrole compound during polymerization, which is supplied to the impregnable material. Suitably, the substance is supplied in the form of a solution, preferably an aqueous solution. The conductivity can be influenced positively by the addition of an acid to the aqueous solution. Depending on the type of substance and the time of treatment to achieve a certain desired conductivity, the concentration of the substance is normally between 0.01 and 200 g per 100 ml water or other solvent.

The pyrrole compound can be supplied to the solid impregnable material in gaseous state or in liquid state, possibly then dissolved in a solvent such as an alcohol or a nitrile. The polymerization of the pyrrole compound may advantageously be carried out at room temperature. The solid impregnable material is suitably maintained in contact with the pyrrole compound until all pyrrole compound, which may come into contact with the substance which influences the polymerization, has polymerized. The amount of polypyrrole compound in the finished product is then dependent on the supplied amount of said substance. The amount of pyrrole compound in the finished product is suitably from 0.1 to 20% of the weight of the solid material.

The invention will be explained in greater detail by describing some examples.

EXAMPLE 1

A paper of cellulose with an absorption capacity of 2 grams of water per gram of paper is dipped into a solution (aqueous solution) of $FeCl_3.6H_2O$ in 0.01M HCl. The paper is immersed while still wet in a pyrrole liquid of room temperature and is maintained in the pyrrole until all pyrrole, which has come into contact with the ferric chloride, has polymerized. The treated paper thereby receives a resistivity which is dependent on the concentration of $FeCl_3$ in the solution, which is clear from the following table.

| $FeCl_3.6H_2O$ g per 100 ml 0.01 M HCl | Resistivity after drying in room air for 24 hours at 20° C. ohmcm |
|---|---|
| 0 | $3 \times 10^{13}$ |
| 0.1 | $6 \times 10^{11}$ |
| 0.25 | $2 \times 10^{10}$ |
| 0.5 | $1 \times 10^{9}$ |
| 0.75 | $5 \times 10^{8}$ |
| 1 | $4.0 \times 10^{6}$ |
| 2 | $4.9 \times 10^{4}$ |
| 4 | $6.5 \times 10^{3}$ |
| 6 | $1.3 \times 10^{3}$ |
| 8 | $6.1 \times 10^{2}$ |
| 10 | $3.5 \times 10^{2}$ |
| 12 | $3.6 \times 10^{2}$ |
| 14 | $2.1 \times 10^{2}$ |
| 90 | $6.5 \times 10^{1}$ |

The resistivity is measured in a Keithley 610 C electrometer in those cases where the number of grams of $FeCl_3$ is lower than 2, and in a Simpson model 461 digital multimeter in those cases where the number of grams of $FeCl_3$ is higher than 2.

EXAMPLE 2

A paper of the same kind as that stated in Example 1 is dipped into a solution containing 10 grams of $FeCl_3.6H_2O$ in 100 ml of a solvent of the kind stated in the table below. The paper is then placed, while still in wet state, in a chamber of room temperature to which pyrrole in gaseous state is supplied. When all pyrrole, which has come into contact with the ferric chloride, has polymerized, the treatment is terminated. As will be clear from the table below, the treated paper then receives a lower resistivity if water is used as solvent than if certain organic solvents are used. The resistivity will be particularly low if HCl has been added to the water.

| Solvent | Resistivity after drying in room air for 24 hours at 20° C. ohmcm |
|---|---|
| .01 M HCl | $5.6 \times 10^{2}$ |
| $H_2O$ | $2.3 \times 10^{3}$ |
| $CH_3CN$ | $4.4 \times 10^{5}$ |
| $C_2H_5OH$ | $2.0 \times 10^{5}$ |

EXAMPLE 3

A paper of the same kind as that stated in Example 1 is dipped into different solutions, each one containing 10 grams of a substance with the ability to give polypyrrole higher conductivity than paper in 100 ml $H_2O$. While still in wet state, the paper is treated with pyrrole in gaseous state in the manner stated under Example 2. The resistivities obtained appear from the following table.

| Substance | Resistivity after drying in room air for 24 hours at 20° C. ohmcm |
|---|---|
| $FeCl_3.6H_2O$ | $2.3 \times 10^{3}$ |
| $Ce(SO_4)_2.4H_2O$ | $5.6 \times 10^{5}$ |
| $K_3(Fe(CN)_6)$ | $1.0 \times 10^{4}$ |
| $H_3PMo_{12}O_{40}$ | $2.2 \times 10^{4}$ |

-continued

| Substance | Resistivity after drying in room air for 24 hours at 20° C. ohmcm |
|---|---|
| $CrO_3$ | $4.5 \times 10^{6}$ |

EXAMPLE 4

A paper of cellulose with an absorption capacity of 2 grams of water per gram of paper is dipped into a solution (aqueous solution) of $FeCl_3.6H_2O$ in 0.01M HCl. While still in wet state, the paper is placed in a chamber of room temperature to which N-methylpyrrole in gaseous form is supplied. When all the N-methylpyrrole, which has come into contact with the ferric chloride, has polymerized, the treatment is terminated. The treated paper thereby receives a resistivity which is dependent on the concentration of $FeCl_3$ in the solution, which will be clear from the following table.

| $FeCl_3.6H_2O$ g per 100 ml 0.01 M HCl | Resistivity after drying in room air for 24 hours at 20° C. ohmcm |
|---|---|
| 0 | $3 \times 10^{13}$ |
| 2 | $3 \times 10^{9}$ |
| 4 | $7 \times 10^{8}$ |
| 6 | $3 \times 10^{8}$ |
| 8 | $2 \times 10^{8}$ |

The resistivity is measured in a Keithley 610 C electrometer.

EXAMPLE 5

Fibres of unbleached sulphate cellulose are suspended in water into a slurry containing 1.5 grams of fibres per liter of water. 22 grams of $FeCl_3.6H_2O$ are added to the slurry, whereby the fibre becomes impregnated with ferric chloride. Thereafter, 0.4 grams of N-methylpyrrole are added to the slurry and the slurry is shaken repeatedly. The whole treatment is carried out at room temperature. The slurry is then filtered in a Büchner funnel. A felt-like product, built up of fibres with poly(N-methylpyrrole), is then obtained in the funnel. The resistivity of the product decreases, as will be clear from the table below, with the time for the treatment of the fibre with N-methylpyrrole. By the treatment time for the fibre with N-methylpyrrole is meant, in the table, the time from the addition of the N-methylpyrrole to the slurry until the slurry has been filtered.

| Treatment time for the fibre with N—methylpyrrole | Resistivity after drying in air for 1 hour at 100° C. ohmcm |
|---|---|
| 3 minutes | $>10^{14}$ |
| 30 minutes | $10^{11}$–$10^{13}$ |
| 24 hours | $10^{6}$–$10^{10}$ |

By very vigorous shaking (better contact between the reactants) the time for achieving a given resistivity can be shortened.

Instead of pyrrole and N-methylpyrrole, respectively, there may be used in the Example mixtures of pyrrole and N-methylpyrrole, for example, a mixture of equal parts of pyrrole and N-methylpyrrole.

We claim:

1. A method of increasing the electrical conductivity of a solid, impregnable material which comprises the steps of (1) providing a chemical compound containing a metal ion which is capable of changing its valence in said solid, impregnable material, said chemical compound being capable, during the polymerization of a pyrrole compound selected from the group consisting of pyrrole and N-methylpyrrole and mixtures thereof, of providing the produced polymer with a higher electrical conductivity than that of said solid, impregnable material, (2) adding a pyrrole compound selected from the group consisting of pyrrole and N-methylpyrrole mixtures thereof to said solid, impregnable material from step (1), and (3) allowing said pyrrole compound in the solid, impregnable material from step (2) to polymerize.

2. The method as defined in claim 1 wherein said chemical compound consists of a ferric compound.

3. The method as defined in claim 1 wherein in step (1) said solid, impregnable material is impregnated with a solution containing said chemical compound.

4. The method as defined in claim 3 wherein said solution is an aqueous solution.

5. The method as defined in claim 4 wherein said aqueous solution includes an acid.

6. The method as defined in claim 1 wherein in step (2) said solid, impregnable material is treated with the pyrrole compound in a liquid state.

7. The method as defined in claim 1 wherein in step (2) said solid, impregnable material is treated with the pyrrole compound in a gaseous state.

8. The method as defined in claim 1 wherein said solid, impregnable material comprises a cellulose-based insulating material.

9. The method as defined in claim 8 wherein said cellulose-based insulating material is paper.

10. The method as defined in claim 8 wherein said cellulose-based insulating material is pressboard.

* * * * *